US010283228B2

(12) United States Patent
Fletcher

(10) Patent No.: US 10,283,228 B2
(45) Date of Patent: May 7, 2019

(54) X-RAY BEAM COLLIMATOR

(71) Applicant: NIKON METROLOGY NV, Leuven (BE)

(72) Inventor: Stephen M. Fletcher, Rickmansworth (GB)

(73) Assignee: NIKON METROLOGY NV, Leuven (BE)

( * ) Notice: Subject to any disclaimer, the term of this patent is extended or adjusted under 35 U.S.C. 154(b) by 182 days.

(21) Appl. No.: 15/503,316

(22) PCT Filed: Aug. 12, 2015

(86) PCT No.: PCT/EP2015/068559
§ 371 (c)(1),
(2) Date: Feb. 10, 2017

(87) PCT Pub. No.: WO2016/023950
PCT Pub. Date: Feb. 18, 2016

(65) Prior Publication Data

US 2017/0229204 A1 Aug. 10, 2017

(30) Foreign Application Priority Data

Aug. 13, 2014 (GB) ..... 1414393.7

(51) Int. Cl.
*H01J 35/18* (2006.01)
*G21K 1/02* (2006.01)

(52) U.S. Cl.
CPC ..... *G21K 1/02* (2013.01); *H01J 35/18* (2013.01); *H01J 2235/087* (2013.01)

(58) Field of Classification Search
None
See application file for complete search history.

(56) References Cited

U.S. PATENT DOCUMENTS 3,679,927 A * 7/1972 Kirkendall ..... H01J 35/18 313/153
4,300,055 A 11/1981 Taumann
(Continued)

FOREIGN PATENT DOCUMENTS

EP 0021441 A2 1/1981
EP 0021442 A1 1/1981
(Continued)

OTHER PUBLICATIONS

Search Report in related GB Application No. GB1414393.7 dated Jan. 29, 2015, 5 pages.
(Continued)

*Primary Examiner* — Hoon K Song
(74) *Attorney, Agent, or Firm* — Andrew M. Calderon; Roberts Mlotkowski Safran Cole & Calderon, P.C.

(57) ABSTRACT

Disclosed is an X-ray beam collimator. In one configuration, the collimator comprises an X-ray collimating portion having an X-ray transmission aperture formed therein. In one configuration, an electron absorbing portion is positioned in or arranged to overlie the X-ray transmission aperture. In one configuration, the X-ray collimating portion has a thickness in a direction through the aperture greater than a thickness in the same direction of the electron absorbing portion. In one configuration, the collimator comprises an x-ray collimating portion made of a conducting first material having an x-ray transmission aperture formed therein. In one configuration, an electron absorbing portion made of a conducting second material is arranged to plug or cover the x-ray transmission aperture. In one configuration, the first material is relatively more radiodense than the second material. Also disclosed is an x-ray beam apparatus, a method of reducing ozone generation and a structure manufacturing method using the disclosed collimator.

21 Claims, 7 Drawing Sheets

(56) References Cited

U.S. PATENT DOCUMENTS

| | | | | |
|---|---|---|---|---|
| 4,309,637 | A | 1/1982 | Fetter | |
| 4,327,293 | A | 4/1982 | Taumann | |
| 4,343,997 | A | 8/1982 | Heinz | |
| 5,486,703 | A | 1/1996 | Lovin et al. | |
| 6,215,852 | B1 | 4/2001 | Rogers et al. | |
| 2012/0039438 | A1 | 2/2012 | Parham et al. | |
| 2014/0192957 | A1* | 7/2014 | Tamura | H01J 35/14 378/62 |
| 2015/0162163 | A1* | 6/2015 | Anno | H01J 35/06 378/123 |
| 2016/0020060 | A1* | 1/2016 | Ohashi | H01J 35/08 378/51 |

FOREIGN PATENT DOCUMENTS

| | | | |
|---|---|---|---|
| GB | 268742 | | 10/1927 |
| GB | 1569883 | A | 6/1980 |

OTHER PUBLICATIONS

International Search Report and Written Opinion in related EP Application No. PCT/EP2015/068559 dated Oct. 9, 2015, 16 pages.

* cited by examiner

SECTION A-A

X-RAY BEAM COLLIMATOR

FIELD OF THE INVENTION

The present invention relates to an x-ray beam collimator for an x-ray beam apparatus, and particularly to an x-ray beam collimator which is able to suppress the production of ozone in the x-ray apparatus. The disclosure also relates to an x-ray beam apparatus using the collimator, as well as a method of reducing ozone generation in an x-ray beam apparatus using the collimator.

BACKGROUND

For x-ray imaging applications, x-rays are often generated by a transmission-target x-ray generator having a schematic configuration as shown in FIG. 1.

The x-ray generator 100 shown in FIG. 1 includes an electron-beam generator 110 which generates an electron beam travelling in the direction indicated by arrow $B_e$. The electron beam strikes plate-like target 120 made of a high-Z (high atomic number) material such as tungsten, such that x-rays are emitted from the material. The principal intended direction of emission of the x-rays is shown by schematic arrow $B_x$ in FIG. 1, although this arrow in reality only indicates an axis of symmetry for the x-ray generation since the x-rays are emitted in a relatively large range of angles to the incident electron beam direction $B_e$, although emission in the sideways and reverse directions is supressed to some extent by absorption of the x-rays in the target 120. The x-ray beam has a characteristic energy spectrum which depends on both the material from which target 120 is made and the energy distribution of electrons in the incident electron beam.

The configuration of the x-ray generator shown in FIG. 1, being a transmission-target configuration, is thus distinct from a reflection-target configuration, which uses a relatively thicker target and in which the intended direction of emission of the x-rays is at an angle greater than 90 degrees to the incident electron beam direction $B_e$ to the surface of the target.

Both the electron beam generator 110 and target 120 are enclosed in vacuum enclosure 140, since the presence of matter inhibits the transmission of the electron beam. Vacuum enclosure 140 is generally not transparent to x-rays, so is provided with an x-ray emission window 130 positioned downstream of the target 120, i.e. on the opposite side to the electron beam generator 110, in the intended direction of emission of the x-rays $B_x$. The window 130 is made of a material which is relatively transparent to x-rays, i.e. having a low radiodensity and being relatively thin. Therefore, x-rays generated in target 120 which impinge upon window 130 are able to pass through window 130 and exit the apparatus. X-rays generally easily pass through air and other gases, so the x-ray beam is not significantly attenuated after passing through window 130. Window 130 is commonly made of beryllium, which has a very low radiodensity relative to other materials.

Since x-rays are generated in target 120 at a range of angles to the electron beam direction $B_e$, it is necessary to reduce the angular spread of the beam sufficient to avoid unintended irradiation of objects near to the beam path. Typically, this is achieved by means of a collimator 150, which provides a layer of x-ray absorbing, i.e. radiodense, material positioned in the x-ray beam having emerged from window 130, the layer having a central aperture through which the x-rays can pass. X-rays which do not pass through the aperture are absorbed in the radiodense material, the eventual angular spread of the resultant beam being determined by the diameter of the aperture and the distance of the collimator 150 from the target 120.

Herein, reference has been made to radiodensity as a property of materials determining their ability to transmit x-rays. Radiodensity may be measured, for example, by the Hounsfield scale, in which distilled water has a value of zero Hounsfield units (Hu) while air has a value of minus 1000 Hounsfield units (Hu). Relative radiodensity does not significantly very with x-ray energy, but may, for example, be measured or calculated with a characteristic x-ray beam energy of 200 keV.

In arrangements such as shown in FIG. 1, it has been noticed that ozone is sometimes generated by such an x-ray source. The presence of ozone is of concern to both manufacturers and users. Therefore, there is a need to suppress the production of ozone in such x-ray apparatus.

SUMMARY

According to a first aspect of the present disclosure, there is provided an X-ray beam collimator comprising: an X-ray collimating portion having an X-ray transmission aperture formed therein; an electron absorbing portion positioned in or arranged to overlie the X-ray transmission aperture, wherein the X-ray collimating portion has a thickness in a direction through the aperture greater than a thickness in the same direction of the electron absorbing portion.

According to a second aspect of the present disclosure, there is provided an x-ray beam collimator for a transmission-target x-ray generator, the collimator comprising: an x-ray collimating portion made of a conducting first material having an x-ray transmission aperture formed therein; and an electron absorbing portion made of a conducting second material arranged to plug or cover the x-ray transmission aperture, wherein the first material is relatively more radiodense than the second material.

In one configuration, the first material is composed of more than 50% by mass of elements having atomic number greater than 54.

In one configuration, the second material is composed of more than 50% by mass of elements having atomic number of 54 or less.

In one configuration, the first material is composed of greater than 50% by mass of tungsten.

In one configuration, the second material is composed of greater than 50% by mass of aluminium and/or beryllium.

In one configuration, the collimating portion has a thickness in a direction through the aperture of equal to or greater than a thickness in the same direction of the absorber portion.

In one configuration, the absorbing portion is formed as a plug shaped to fit the aperture.

In one configuration, the absorbing portion is removable from the aperture.

In one configuration, the collimating portion has a planar face in which the aperture is formed.

In one configuration, the absorbing portion has a planar face, and the planar face of the absorbing portion and the planar face of the collimating portion are parallel.

In one configuration, the absorbing portion and the collimating portion share a common face including the respective planar faces.

In one configuration, the collimating portion is formed as a plate.

In one configuration, the collimating portion has a thickness in a direction through the aperture of between 0.5 mm and 5 mm, preferably between 1 mm and 2.5 mm, most preferably 1.5 mm.

In one configuration, the absorbing portion has a thickness in a direction through the aperture of between 0.1 mm and 1 mm, preferably between 0.2 mm and 0.5 mm, most preferably 0.375 mm.

In one configuration, the collimating portion has an absorption factor, defined as a thickness of the collimator portion in a direction through the aperture multiplied by the radiodensity of the second material, being greater than an absorption factor, defined as a thickness in a direction through the aperture multiplied by the radiodensity of the first material, of the absorbing portion.

According to a third aspect of the present disclosure, there is provided an x-ray beam apparatus comprising: an electron beam source for generating an electron beam; a transmission target arranged in an electron beam path of the electron beam source for generating x-rays from the electron beam; a vacuum enclosure enclosing the source and the target, the vacuum enclosure having an x-ray emission window arranged to pass x-rays generated by the target; and a collimator according to the first or second aspect arranged over the x-ray emission window such that x-rays generated by the target pass through the aperture.

In one configuration, the absorbing portion is arranged to come close to or to contact the x-ray emission window.

According to a fourth aspect of the present disclosure, there is provided a method of reducing ozone generation in a transmission-target x-ray beam apparatus comprising arranging a collimator according to the first or second aspect over an x-ray emission window of the x-ray beam apparatus such that the x-ray beam passes through the aperture.

In one configuration, the absorbing portion is arranged to come close to or to contact the x-ray emission window.

According to a fifth aspect of the present disclosure, there is provided a structure manufacturing method comprising:

creating design information with respect to a profile of a structure; forming the structure based on the design information; measuring the profile of the formed structure by using the X-ray beam apparatus according to the third aspect; and comparing the profile information obtained in the measuring with the design information.

In one implementation, the method further comprises repairing the structure based on a comparison result of the comparing.

In one implementation, the repairing and the forming of the structure is carried out a further time.

Effects and advantages of the various aspects, configurations and implementations, together with their various modifications and variants herein disclosed, will be apparent to those skilled in the art from the following disclosure.

BRIEF DESCRIPTION OF THE DRAWINGS

For a better understanding of the present invention, and to show how the same may be carried into effect, reference will be made, by way of example only, to the accompanying drawings, in which.

DETAILED DESCRIPTION

When studying the problem of ozone generation in x-ray beam apparatuses, the present inventors recognised that ozone generation could occur if, for example, damage to target 120 rendered target 120 so thin that not all of the electron beam was absorbed by target 120, and instead permitted electrons to pass through target 120, through window 130, and into the atmosphere outside the x-ray generator. Damage to the window 130 and/or malfunction of electron beam generator 110 could also result in unwanted electrons passing through window 130 and into the surrounding atmosphere. A similar phenomenon could occur also under normal operation if the demanded x-ray energy is so high that the target 120 and window 130, even in an undamaged state, are not able to absorb the total electron flux. The interaction of such electrons, typically having energy of the order of hundreds of kilovolts, could interact with the oxygen in the atmosphere to generate ozone. The inventors also recognised that a new design of collimator 150 would allow an effective remedy to the problem of ozone generation which could be incorporated in new x-ray beam generators as well as retrofitted to existing generators.

Figure 1:
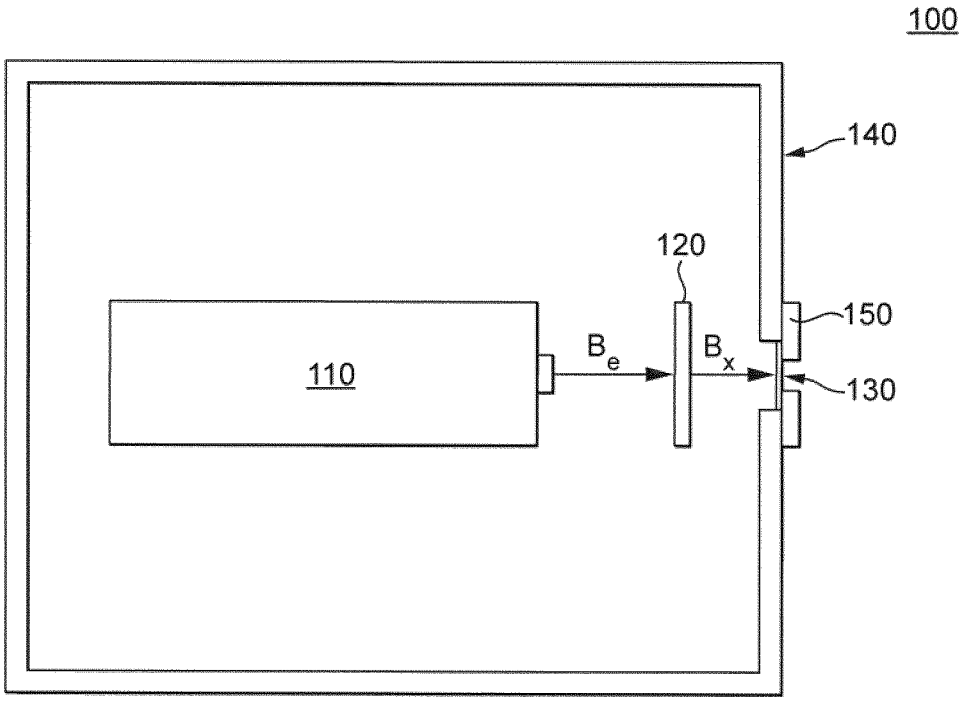
FIG. 1 shows an x-ray apparatus usable with embodiments of the present invention.
Figure 2A:
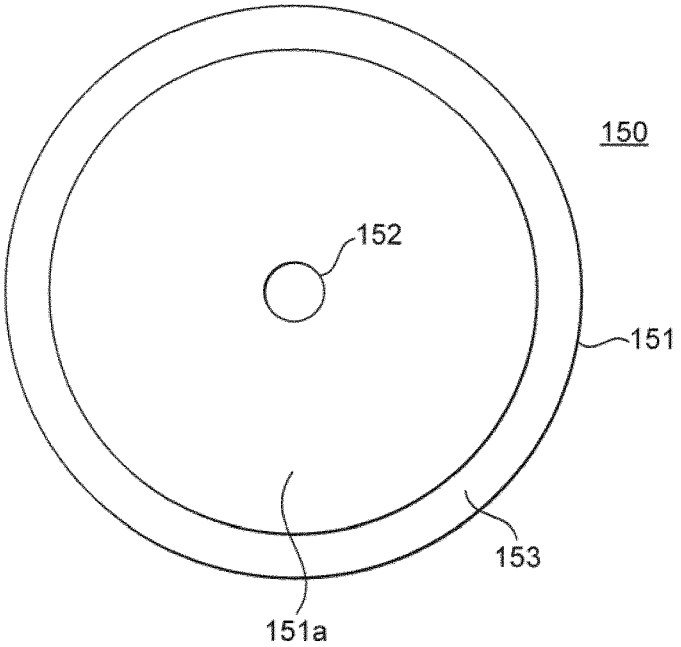
FIG. 2 shows a conventional collimator for an x-ray apparatus as shown in FIG. 1.
Figure 2B:
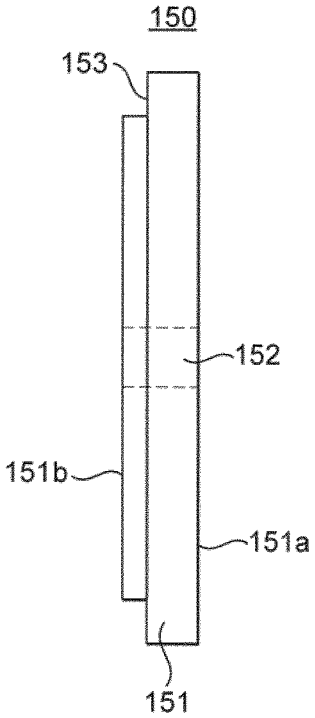

A typical collimator as known in the art and usable with the configuration of FIG. 1 is shown in FIGS. 2A and 2B. FIG. 2A shows a plan view of the collimator 150, while FIG. 2B shows a cross-sectional view of collimator 150.

Collimator 150 is generally planar and disk-like, having a main body 151 with front surface 151*a* and rear surface 151*b* and an aperture 152 connecting the surfaces to allow transmission of x-rays. Surface 151*a* is parallel to surface 151*b*, and the walls of aperture 152 are perpendicular to each of these surfaces. Aperture 152 is circular and coaxial with the circumference of collimator 150. Collimator 150 is also provided on the rear side with a peripheral bevel 153 to provide a clamp surface against which a retaining ring or other clamp can position the collimator 150 over the beryllium window 130 as shown in FIG. 1. Collimator 150 is typically made of a material having a relatively high proportion by weight of relatively high-Z elements, for example being a 50% tungsten alloy. Collimator 150 is thus able to absorb x-rays while permitting passage of x-rays having defined incidence positions and angles to aperture 152. The diameter and depth of aperture 150 can be freely selected according to the beam profile desired, provided that collimator 150 retains sufficient thickness to absorb unwanted x-rays to a desired extent.

Figure 3A:
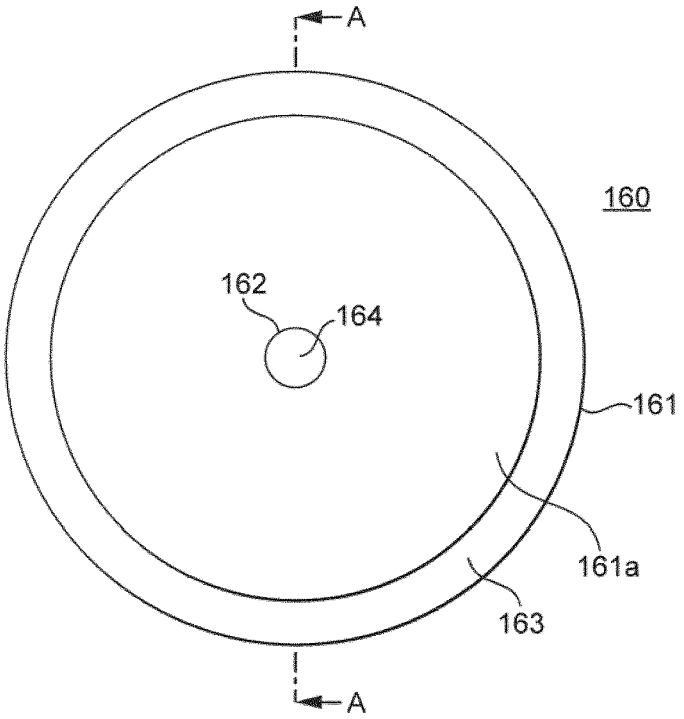
FIG. 3 shows a collimator being an embodiment of the present invention, also usable with the x-ray beam generator as shown in FIG. 1.
Figure 3B:
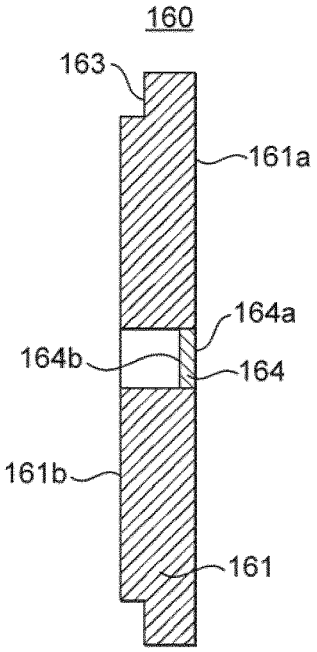

FIGS. 3A and 3B show a modified collimator being an embodiment of the present disclosure. The collimators of FIGS. 2A and 2B and FIGS. 3A and 3B are essentially similar, with parts labelled 16*x* in FIGS. 3A and 3B corresponding to parts labelled 15*x* in FIGS. 2A and 2B. Where the elements of collimator 160 are the same as collimator 150, no further detail will be given, and the reader is referred to the construction of collimator 150. However, collimator 160 is, in addition to the elements shown in FIGS. 2A and 2B, also provided with an absorbing plug 164 located in aperture 162. Absorbing plug 164 is also generally disk-like, and is shaped to fit aperture 162, such that the outer circumference of plug 164 corresponds to the inner circumference of aperture 162.

Plug 164 is made of a material which is relatively less radiodense than the material from which body portion 161 is made. The effect of this difference is that while x-rays are fully absorbed by body portion 161, the x-rays pass through plug 164 relatively unhindered. However, electrons of the electron beam incident on plug 164 are easily absorbed by plug 164. To ensure that a charge does not accumulate on plug 164 during use, both plug 164 and collimator body 161 are conducting and mutually electrically connected, such that charge accumulating thereon may be safely dissipated to earth.

Since penetration depths are much smaller for electron beams than for x-rays in most solid materials, plug 164 can be made relatively thinner in the direction of beam propagation, that is, in the direction normal to surfaces 161*a* and 161*b*, than body 161. This further reduces the influence that the material of plug 164 may also have on the x-ray beam.

It is known that inserting various materials in the path of an x-ray beam can result in a change in the shape of the x-ray spectrum. By reducing the thickness of plug 164, this effect can be correspondingly reduced as desired.

Further, a material such as beryllium can be used to make plug 164, which is generally very transparent to x-rays and does not result in an appreciable change in the x-ray spectrum passing through the plug.

Alternatively, the thickness of plug 164 and the material of plug 164 may be selected so as to provide selective shaping or filtering of the x-ray spectrum, as desired. For example, if plug 164 is made of aluminium, the effect of the aluminium on the beam will be to reduce low-energy x-rays, such that the x-ray spectrum becomes relatively more peaked about the high-x-ray energies. The thickness of the plug 164 can then be selected to determine the amount of hardening of the x-ray spectrum achieved.

One skilled in the art will easily be able to determine or appreciate the effect of other materials or alloys on the electron beam and to select the material of plug 164 accordingly.

In general, materials containing a high proportion, such as greater than 50% by weight, of elements having an atomic number greater than 54 may be particularly appropriate for forming body 161, while materials containing a high proportion, such as greater than 50% by weight, of elements having atomic number less than 54 may be appropriate for forming the plug 164. Of course, both alloys and pure elements can be considered for forming either body 161 or plug 164, without limitation.

Considering FIG. 3B further, it can be seen that plug 164 has two parallel faces, a front face 164*a* and a rear face 164B. Front face 164*a* is positioned to be coplanar with front face 161*a* of the collimator. This allows the front face 164*a* of plug 164 to be placed close to or against window 130 in the configuration of FIG. 1, such that no or little atmosphere exists between window 130 and plug 164. For example, a gap less than 1 mm, 0.5 mm, 0.1 mm, or 0.05 mm may be allowed between window 130 and plug 164. This ensures that, if the electron beam does penetrate window 130, it interacts with no or minimal atmosphere before being absorbed in plug 164.

Rear face 164*b* of plug 164 is parallel to front face 164*a*, which is preferred for homogeneity reasons but is not essential.

In one configuration, plug 164 is removable from aperture 162, while in another configuration, plug 164 is fixed in aperture 162. When plug 164 is removable, plug 164 can be made interchangeable, such that a range of materials and thicknesses of material can be used as the plug, or no plug at all, depending on the x-ray energy desired, the electron-beam energy used, and the particular application. Different thicknesses of plug 164 may be chosen, for example in the case of aluminium, in order to adjust the degree of x-ray beam spectrum shaping achieved. Plugs can be made of stacked layers of different materials, or multiple plugs can be stacked, depending on the effect desired on the beam.

When plug 164 is removable, plug 164 can be introduced into aperture 162 only once significant ozone is detected in the machine, to extend the life of the apparatus before the target requires replacement or to inhibit ozone generation until a technician can effect repair. Plug 164 is expected to have only a minimal effect on the intensity of x-rays achieved, so by taking such action the apparatus remains usable with only a small or no decrease in performance.

Preferably, body portion 161 is made of tungsten or a tungsten alloy, being, for example, greater than 50% by mass of tungsten, while plug 164 is made of aluminium, beryllium, or an alloy thereof, being composed of greater than 50% by mass of either or both these elements.

Variations of the geometry shown in FIGS. 3A and 3B can also be contemplated. For example, neither main body 161 nor plug 164 need have a plate-shaped configuration, and could have other geometries. Further, provided that the material from which portion 161 was formed was sufficiently radiodense, thickness of portion 161 could be reduced to be comparable to or even smaller than the thickness of plug 164. Alternatively, plug 164 could be formed as a thin plate arranged on surface 161*a* to cover, rather than to plug, aperture 162.

Variations on the dimensions of aperture 162 may be contemplated. A variation is also contemplated wherein the aperture is formed to have a stepped or countersunk portion, such that the aperture at surface 161*a* has a greater diameter than the aperture at surface 161*b*. The plug 164 can then be appropriately shaped to plug the countersunk portion of aperture 164 without penetrating too far down aperture 164. Alternatively, both aperture and plug can be formed with a corresponding taper. This can help to ensure that surfaces 161*a* and 164*a* are and remain coplanar, as well as facilitating the interchange of different plug portions 164.

As to dimensions, these are not particularly limited, and can be freely chosen based on the materials used and the x-ray and electron beam energies in use, as well as the effect intended on the x-ray beam. Presently preferred for the configuration shown in FIG. 3 is a main body portion 161 of thickness between 0.5 mm and 5 mm, preferably between 1 mm and 2.5 mm, most preferably 1.5 mm. As regards plug 164, it is preferred that the thickness in a direction normal to surface 161A, namely, the beam direction, is between 0.1 mm and 1 mm, preferably between 0.2 mm and 0.5 mm, most preferably 0.375 mm. These dimensions, employed for example in a 50% tungsten alloy collimator and a pure aluminium plug, permit good absorption of the x-ray beam and electron beam by the main body portion and plug respectively, while allowing the x-ray beam to pass the plug relatively unhindered.

However, these dimensions can be varied, provided that the total attenuation provided to the x-ray beam by plug 164 is less than the attenuation provided by the x-ray beam to main body portion 161. If an absorption factor for a particular portion of the collimator 160 is defined to be the thickness of the collimator portion in a direction through the aperture, normal to surface 161*a*, multiplied by the radiodensity of the material of which the portion is formed, it is preferred that the absorption factor of the body portion 161 is greater, preferably by a factor of 10, most preferably by a factor of 100, than that of the plug portion 164.

The collimator of the present disclosure may be incorporated in a new x-ray machine or may be retrofitted to an existing x-ray machine to suppress ozone generation. In some cases, the collimator may substitute an existing collimator, the geometry of which it may be formed to resemble. Alternatively, the collimator can be provided to an x-ray beam apparatus which does not previously have or is not designed to have a collimator by installing it over the x-ray emission window.

One detailed example of an x-ray generator, or x-ray source, including a collimator in accordance with the present disclosure, together with a detailed example of a detection system and a structure manufacturing method using the x-ray generator, will now be given. Common reference numerals with the schematic of FIG. 1 have been used to represent comparable structures.

Figure 4:
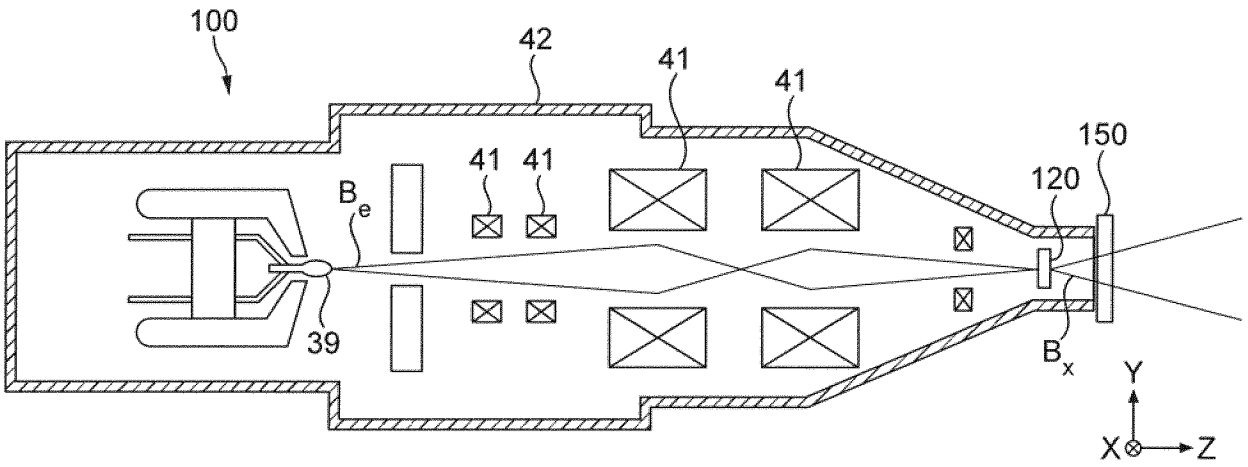
FIG. 4 shows one detailed example of an x-ray source including a collimator being an embodiment of the present invention.

FIG. 4 is a cross-sectional view showing a detailed example of X-ray source 100. In FIG. 4, the X-ray source 100 includes a filament 39 generating electrons, a target 120 generating an X-ray by interaction with the electrons, and electron beam adjustment members 41 modifying the properties of the electron beam and directing the electrons of the electron beam to the target 120. Further, the X-ray source 100 includes a housing 42 accommodating at least some of the electron deflection members 41. In this configuration, the housing 42 accommodates all of the filament 39, the electron conduction members 41, and the target 120.

The filament 39 contains atoms or ions of an element such as tungsten which is able to emit electrons via the thermoelectric effect. When an electric current flows through the filament 39 and the filament 39 is heated by the electric current, electrons, normally termed thermoelectrons, are emitted from the filament 39. The filament 39 is shaped with a pointed apical end. Such a shape enables easy emission of the electrons. In this example, the filament 39 is formed from a coiled wire which is deformed into the shape having the pointed apicial end. However, other configurations of filament are possible as understood in the art. Further, the supply source of the electrons (thermoelectrons) in the X-ray source 2 is not necessarily limited to a filament. For example, it is also possible to use an electron gun which uses another phenomenon to generate the electrons, such as a photocathode source, a field emission or cold emission source, or a plasma source.

The target 120 generates the X-ray by fluorescent emission due to the collision of the electrons with atoms or ions in the target or by a Bremsstrahlung process in which the X-ray radiation results from the motion of the electrons in the electric field of the nuclei of the atoms or ions. Both of these processes are normally expected to occur. In the present example, the X-ray source 100 is a so-called transmission type, in which the desired x-rays are obtained at the opposite side of the target to the incident beam, in a propagation direction along the same direction as the incident electron beam.

Considering the target 120 as the anode and the filament 39 as the cathode, when a voltage is applied between the target 120 and the filament 39, then the thermoelectrons emitted from the filament 39 will accelerate toward the target 120 (anode) to irradiate the target 120. By virtue of this irradiation, X-rays are generated from the target 120.

The electron beam adjustment members 41 are arranged in at least part of the periphery of the pathway of the electrons from the filament 39 between the filament 39 and the target 120. Each of the electron beam adjustment members 41 includes, for example, an electron lens such as a focusing lens and an objective lens and the like, or a polarisation transforming element such as a polariscope or the like, to adjust the shape, direction and other properties of the electron beam so as to direct the electrons from the filament 39 in a desired state onto the target 120.

The electron beam adjustment members 41 cause the electrons to collide against some area of the target 120, which is generally termed the focal point of the X-ray. The dimension of the area, which is generally termed the spot size, in the target 120 against which the electrons collide is sufficiently small so as to generate a substantially point X-ray source.

In this configuration, collimator 150 is disposed in the +Z direction against target 120. The target 120 disposed between the collimator 150 and filament 39. The collimator 150 may be movable, removable or fixed.

The above explanation has been given with regard to an X-ray source 100 which uses a transmission target, but the application of the collimator of the present disclosure is not so limited For example, the X-ray source can instead use a reflection target or a rotation target, for example if scattered electrons from such targets in the beam direction are of concern.

Now, with reference to FIG. 5, an example of a detection apparatus using the x-ray source of FIG. 4 will be described in detail. In the following explanation, the same reference numerals will be assigned to the constitutive parts or components which are the same as or equivalent to those of the example described above, and the explanations of which will be simplified or omitted. Where information is not explicitly given, one skilled in the art is directed to the above disclosure and/or to the various ways of implementing such an apparatus or function as may be known in the art.

Figure 5:
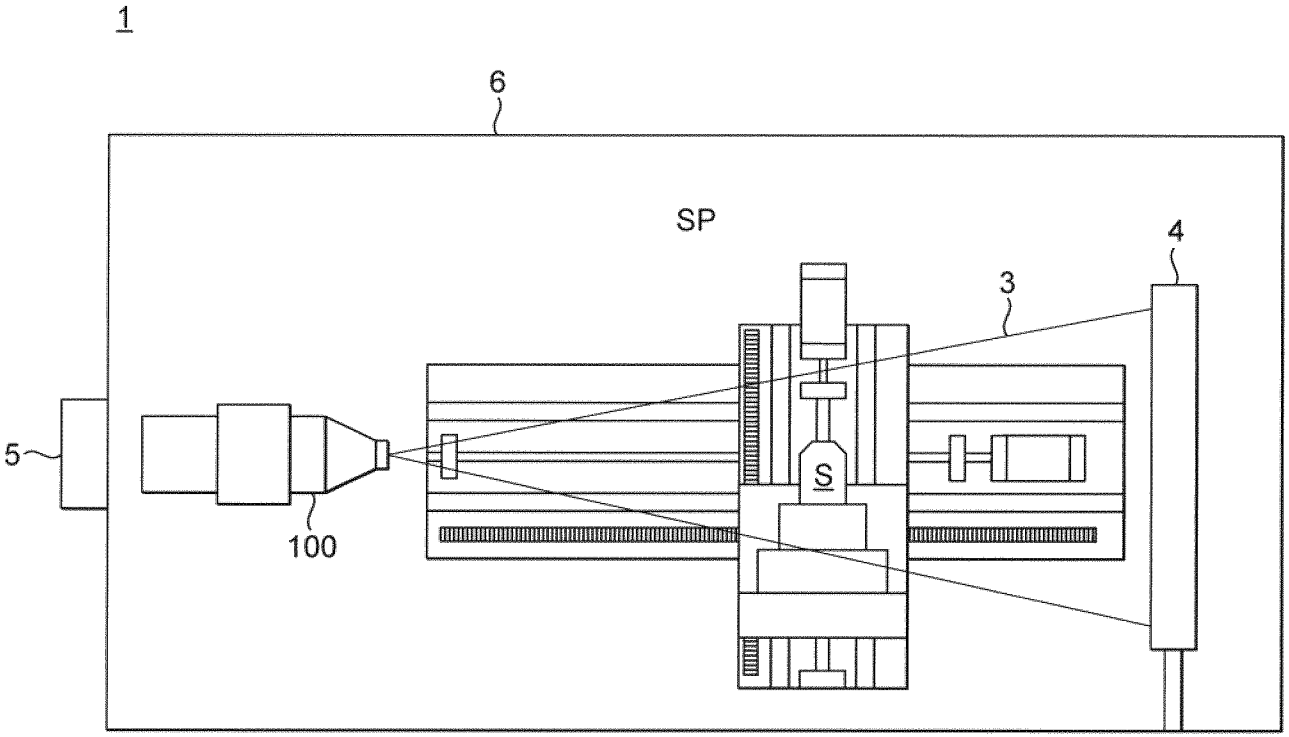
FIG. 5 shows one detailed example of a detection apparatus using the x-ray source according to FIG. 4.

FIG. 5 is a view showing an example of a detection apparatus 1. The detection apparatus 1 irradiates a measuring object S with an X-ray XL to detect a transmission X-ray transmitted through the measuring object S.

In the configuration of FIG. 5, the detection apparatus 1 includes an X-ray CT detection apparatus irradiating the measuring object S with the X-ray and detecting the transmission X-ray transmitted through the measuring object S, so as to non-destructively acquire internal information of the measuring object S (the internal structure, for example).

Here, the measuring object S may be components for industrial use such as machine components, electronic components, and the like.

In FIG. 5, the detection apparatus 1 includes an X-ray source 100 as above mentioned emitting the X-ray XL, a movable stage device 3 retaining the measuring object S, a detector 4 detecting the transmission X-ray transmitted through the measuring object S retained by the stage device 3, and a control device 5 controlling the operation of the entire detection apparatus 1.

Further, the detection apparatus 1 includes a chamber member 6 defining an internal space SP in which the X-ray XL emitted from the X-ray source 2 proceeds.

In the disclosed configuration, the chamber member 6 contains lead. The chamber member 6 restrains the X-ray XL in the internal space SP from leaking out into an external space RP of the chamber member 6. Other means of providing x-ray shielding may be provided as known in the art, or if there is no requirement for such shielding, the chamber member 6 may be omitted.

The movable stage device 3 is rotatable while retaining the measuring object S. The movable stage device 3 is rotatable in the θY direction and movable in the linear X-axis direction, Y-axis direction and Z-axis direction. Further, it is also possible for the drive system 10 to move the measuring object S retained on the table 12 in six directions, i.e. the X-axis, Y-axis, Z-axis, θX, θY and θZ directions, and/or along or around other non-orthogonal axes.

The detector 4 is arranged on the +Z side from the X-ray source 2 and the stage 9. The detector 4 is fixed at a predetermined position.

The control device 5 calculates the internal structure of the measuring object from the detection result of the detector 4 (step SA3).

In the present configuration, the control device 5 acquires an image of the measuring object S based on the transmission X-ray (X-ray transmission data) transmitted through the measuring object S at each of the respective positions (each rotation angle) of the measuring object S. That is, the control device 5 acquires a plurality of images of the measuring object S.

The control device S carries out a calculating operation based on the plurality of X-ray transmission data (images) obtained by irradiating the measuring object S with the X-ray XL while rotating the measuring object S, to reconstruct a tomographic image of the measuring object S and acquire a three-dimensional data of the internal structure of the measuring object S (a three-dimensional structure). By virtue of this, the internal structure of the measuring object S is calculated. As a method for reconstructing a tomographic image of the measuring object, for example, the back projection method, the filtered back projection method, or the successive approximation method can be adopted. With respect to the back projection method and the filtered back projection method, descriptions are given in, for example, U.S. Patent Application Publication No. 2002/0154728, to which the reader is referred.

The x-ray source 100 described above is also applicable to an X-ray Computed Tomography machine such as disclosed in U.S. Patent Application Publication No 2013/0083896, to which the reader is also referred. The measuring object is not limited to a component for industrial use, but can be, for example, a human body or body part. In other words the X-ray source 100 and detection apparatus described above may have not only industrial use but also medical use. Further, the X-ray source may be provided for other x-ray irradiation requirements such as material treatment by irradiation.

Next, a structure manufacturing system provided with the detection apparatus 1 described above will be described in detail. In the following explanation, the same reference numerals will be assigned to the constitutive parts or components which are the same as or equivalent to those of the example described above, and the explanations of which will be simplified or omitted. Where information is not explicitly given, one skilled in the art is directed to the above disclosure and/or to the various ways of implementing such an apparatus or function as may be known in the art.

Figure 6:
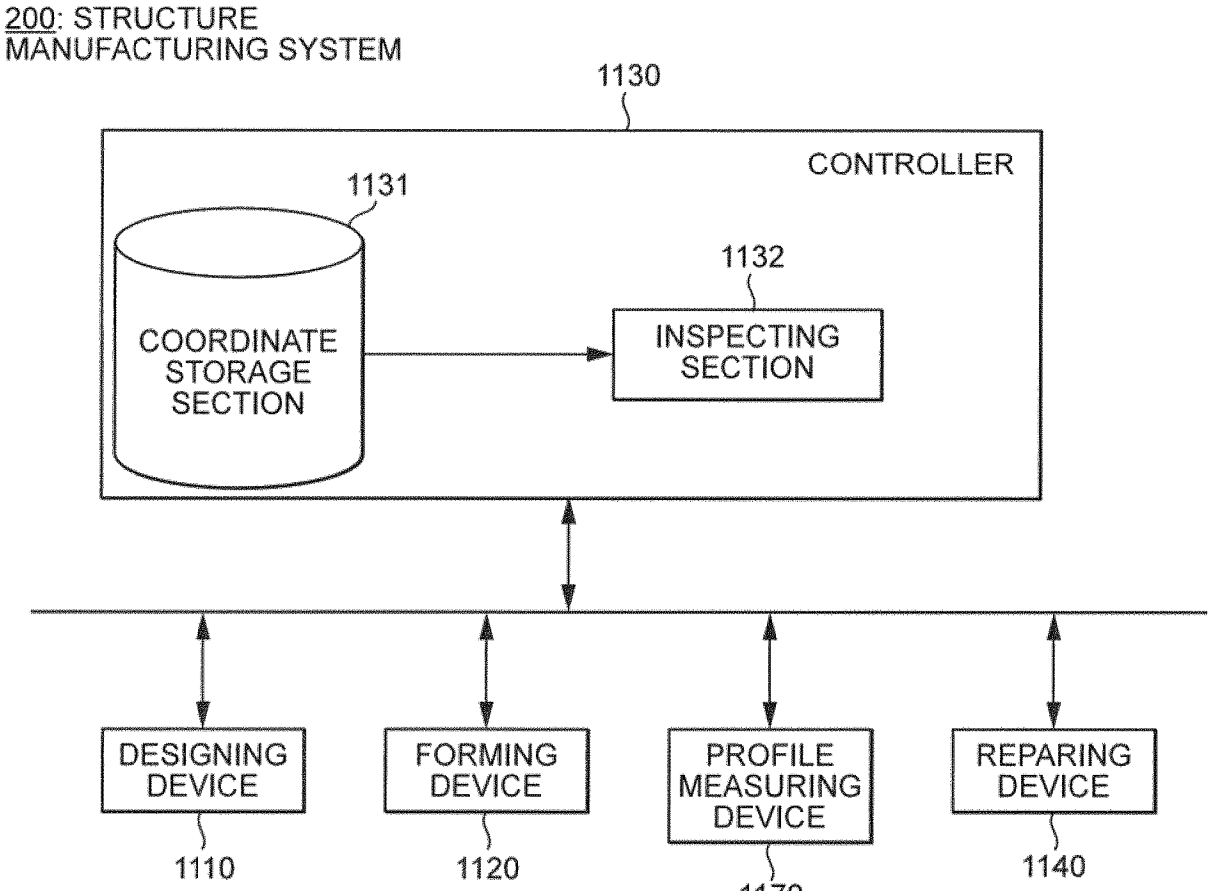
FIG. 6 shows one implementation of a structure manufacturing system incorporating the detection apparatus shown in FIG. 5.

FIG. 6 is a block diagram of a structure manufacturing system 200. The structure manufacturing system 200 includes the aforementioned detection apparatus 1, a forming device 1120, a controller 1130 (also termed an inspection device), and a repairing device 1140. The structure manufacturing system 200 may, for example, be provided to manufacture molded components such as automobile door parts, engine components, gear components, electronic components including circuit substrates, and the like.

A designing device 1110 creates design information about the profile of a structure, and sends the created design information to the forming device 1120. Further, the designing device 1110 stores the created design information into a co-ordinate storage portion 1131 of the controller 1130. The design information mentioned here indicates the co-ordinates of each position of the structure. The forming device 1120 fabricates the structure based on the design information inputted from the designing device 1110. The formation process of the forming device 1120 includes at least one of casting, forging, and cutting.

The detection apparatus 1 sends information indicating measured co-ordinates to the controller 1130. The controller 130 includes the mentioned co-ordinate storage section 1131 and an inspection section 1132. The co-ordinate storage section 1131 stores the design information from the designing device 1110. The inspection section 1132 reads out the design information from the co-ordinate storage section 1131. The inspection section 1132 creates information (also termed profile information) signifying the fabricated structure from the information indicating the co-ordinates received from the detection apparatus 1. The inspection section 1132 compares the information (the profile information) indicating the co-ordinates received from a profile measuring device 1170 with the design information read out from the co-ordinate storage section 1131. Based on the comparison result, the inspection section 1132 determines whether or not the structure is formed in accordance with the design information.

In other words, the inspection section 1132 determines whether or not the fabricated structure is non-defective. When the structure is not formed in accordance with the design information, then the inspection section 1132 determines whether or not it is repairable. When it is repairable, then the inspection section 1132 determines the defective portions and repairing amount based on the comparison result, and sends information to the repairing device 1140 to indicate the defective portions and repairing amount.

Based on the information indicating the defective portions and repairing amount received from the controller 1130, the repairing device 1140 processes the defective portions of the structure to achieve a repair.

Figure 7:
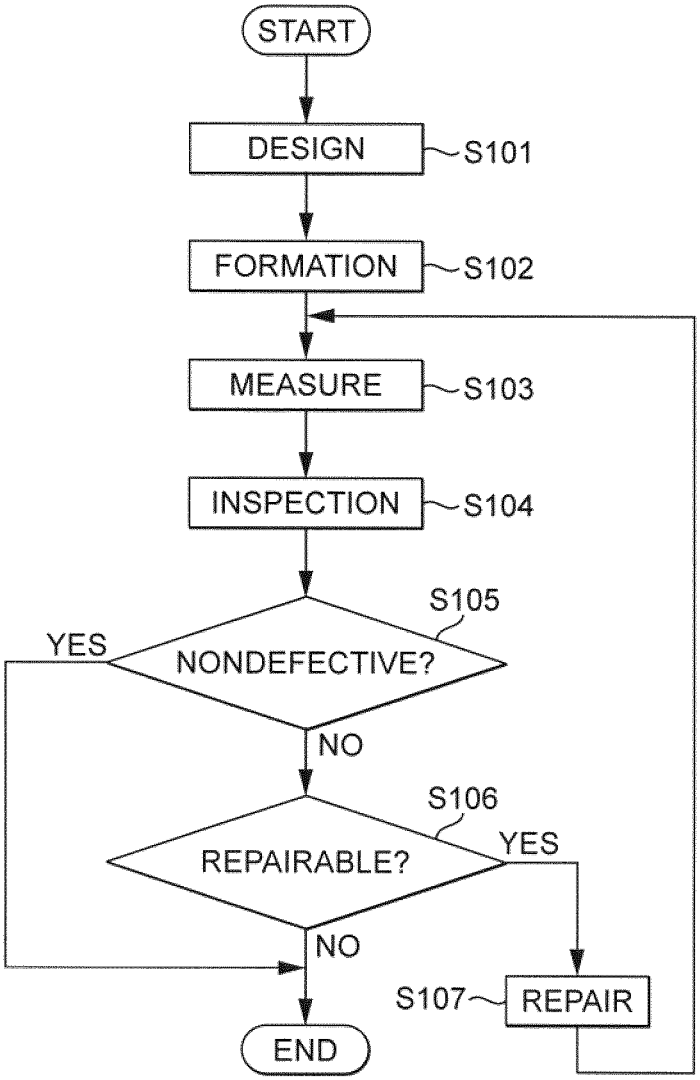
FIG. 7 shows one implementation of a processing flow in the structure manufacturing system of FIG. 6.

FIG. 7 is a flowchart showing a processing flow in the structure manufacturing system 200. First, the design device 1110 creates design information about the profile of a structure (step S101). Next, the forming device 1120 fabricates the structure based on the designing information (step S102). Then, the detection apparatus 1 measures the co-ordinates with respect to the profile of the structure (step S103). Then, the inspection section 1132 of the controller 1130 inspects whether or not the structure is fabricated in accordance with the design information by comparing the created profile information of the structure from the detection apparatus 1 with the above design information (step S104).

Next, the inspection section 1132 of the controller 1130 determines whether or not the fabricated structure is non-defective (step S105). When the fabricated structure is non-defective (step S106: Yes), then the structure manufacturing system 200 ends the process. On the other hand, when the fabricated structure is defective (step S106: No), then the inspection section 1132 of the controller 1130 determines whether or not the fabricated structure is repairable (step S107).

When the fabricated structure is repairable (step S107: Yes), then the repairing device 1140 reprocesses the structure (step S108), and then the process returns to step S103. On the other hand, when the fabricated structure is not repairable (step S107: Yes), then the structure manufacturing system 200 ends the process. With that, the process of the flowchart is ended.

In the above manner, because the detection apparatus 1 in the above example can correctly measure the co-ordinates of the structure, the structure manufacturing system 200 is able to determine whether or not the fabricated structure is nondefective. Further, when the structure is defective, the structure manufacturing system 200 is able to reprocess the structure to repair the same.

In the light of the foregoing disclosure, it is expected that one skilled in the art will be able to modify and adapt the above disclosure to suit his own circumstances and requirements within the scope of the present invention, while retaining some or all technical effects of the same, either disclosed or derivable from the above, in light of his common general knowledge of the art. All such equivalents, modifications or adaptions fall within the scope of the invention hereby defined and claimed.

The invention claimed is:

1. An x-ray beam apparatus comprising:

an electron beam source for generating an electron beam;

a transmission target arranged in an electron beam path of the electron beam source for generating x-rays from the electron beam;

a vacuum enclosure enclosing the electron beam source and the transmission target, the vacuum enclosure comprising an x-ray emission window arranged to pass x-rays generated by the transmission target; and an X-ray beam collimator comprising:

an X-ray collimating portion having an X-ray transmission aperture formed therein;

an electron absorbing portion positioned in or arranged to overlie the X-ray transmission aperture, wherein the X-ray collimating portion has a thickness in a direction through the aperture greater than a thickness in the same direction of the electron absorbing portion; and wherein the X-ray beam collimator is arranged over an outer surface of the vacuum enclosure such that x-rays generated by the transmission target pass through the X-ray transmission aperture.

2. An x-ray beam apparatus comprising:

an electron beam source for generating an electron beam;

a transmission target arranged in an electron beam path of the electron beam source for generating x-rays from the electron beam;

a vacuum enclosure enclosing the electron beam source and the transmission target, the vacuum enclosure comprising an x-ray emission window arranged to pass x-rays generated by the transmission target; and an x-ray beam collimator for a transmission-target x-ray generator, the x-ray beam collimator comprising:

an x-ray collimating portion made of a conducting first material having an x-ray transmission aperture formed therein; and an electron absorbing portion made of a conducting second material arranged to plug or cover the x-ray transmission aperture, wherein the first material is relatively more radiodense than the second material; and wherein the x-ray beam collimator is arranged over an outer surface of the vacuum enclosure such that x-rays generated by the transmission target pass through the x-ray transmission aperture.

3. The x-ray beam apparatus according to claim 2, wherein the first material is composed of more than 50% by mass of elements having atomic number greater than 54.

4. The x-ray beam apparatus according to claim 2, wherein the first material is composed of greater than 50% by mass of tungsten.

5. The x-ray beam apparatus according to claim 2, wherein the second material is composed of more than 50% by mass of elements having atomic number of 54 or less.

6. The x-ray beam apparatus according to claim 2, wherein the second material is composed of greater than 50% by mass of aluminium and/or beryllium.

7. The x-ray beam apparatus according to claim 2, wherein the collimating portion has a thickness in a direction through the aperture of equal to or greater than a thickness in the same direction of the absorber portion.

8. The x-ray beam apparatus according to claim 2, wherein the absorbing portion is formed as a plug shaped to fit the aperture.

9. The x-ray beam apparatus according to claim 2, wherein the absorbing portion is removable from the aperture.

10. The x-ray beam apparatus according to claim 2, wherein the collimating portion has a planar face in which the aperture is formed.

11. The x-ray beam apparatus according to claim 10, wherein the absorbing portion has a planar face, and the planar face of the absorbing portion and the planar face of the collimating portion are parallel.

12. The x-ray beam apparatus according to claim 11, wherein the absorbing portion and the collimating portion share a common face including the respective planar faces.

13. The x-ray beam apparatus according to claim 2, wherein the collimating portion is formed as a plate.

14. The x-ray beam apparatus according to claim 2, wherein the collimating portion has a thickness in a direction through the aperture of between 0.5 mm and 5 mm, preferably between 1 mm and 2.5 mm, most preferably 1.5 mm.

15. The x-ray beam apparatus according to claim 2, wherein the absorbing portion has a thickness in a direction through the aperture of between 0.1 mm and 1 mm, preferably between 0.2 mm and 0.5 mm, most preferably 0.375 mm.

16. The x-ray beam apparatus according to claim 2, wherein the collimating portion has an absorption factor, defined as a thickness of the collimator portion in a direction through the aperture multiplied by the radiodensity of the second material, being greater than an absorption factor, defined as a thickness in a direction through the aperture multiplied by the radiodensity of the first material, of the absorbing portion.

17. The x-ray beam apparatus according to claim 1, wherein the absorbing portion is arranged to come close to or to contact the x-ray emission window.

18. A method of reducing ozone generation in the x-ray beam apparatus according to claim 1, the method comprising arranging the electron absorbing portion to come close to or to contact the x-ray emission window.

19. A structure manufacturing method comprising:

creating design information with respect to a profile of a structure;

forming the structure based on the design information;

measuring a profile of the formed structure by using the X-ray beam apparatus according to claim 1; and comparing the profile obtained in the measuring with the design information.

20. The structure manufacturing method according to claim 19 further comprising repairing the structure based on a comparison result of the comparing.

21. The structure manufacturing method according to claim 20, wherein in the repairing and the forming of the structure is carried out a further time.

* * * * *